US009033071B2

(12) United States Patent
Koga et al.

(10) Patent No.: US 9,033,071 B2
(45) Date of Patent: May 19, 2015

(54) HYDRAULIC EXCAVATOR

(75) Inventors: Mitsuhiro Koga, Hirakata (JP); Naoki Tsujimoto, Hirakata (JP)

(73) Assignee: KOMATSU LTD., Tokyo (JP)

( * ) Notice: Subject to any disclaimer, the term of this patent is extended or adjusted under 35 U.S.C. 154(b) by 83 days.

(21) Appl. No.: 13/990,915

(22) PCT Filed: Sep. 5, 2012

(86) PCT No.: PCT/JP2012/072647

§ 371 (c)(1),
(2), (4) Date: May 31, 2013

(87) PCT Pub. No.: WO2013/175648

PCT Pub. Date: Nov. 28, 2013

(65) Prior Publication Data

US 2014/0284119 A1 Sep. 25, 2014

(30) Foreign Application Priority Data

May 22, 2012 (JP) ..... 2012-116495

(51) Int. Cl.
*E02F 9/08* (2006.01)
*F01N 3/00* (2006.01)

(52) U.S. Cl.
CPC ..... *E02F 9/0858* (2013.01); *E02F 9/0833* (2013.01); *E02F 9/0866* (2013.01); *F01N 3/00* (2013.01)

(58) Field of Classification Search
CPC ..... B62D 33/04; B62D 33/042; E02F 9/0858; E02F 9/0833; E02F 9/0866; F01N 3/00
USPC ..... 180/9.1, 9.23, 9.42, 69.2, 69.24, 89.17, 180/291, 312; 280/781
See application file for complete search history.

(56) References Cited

U.S. PATENT DOCUMENTS

| | | | | |
|---|---|---|---|---|
| 7,481,289 | B2 * | 1/2009 | Ueda et al. | 180/89.16 |
| 2010/0192551 | A1 * | 8/2010 | Yokota | 60/295 |
| 2012/0205172 | A1 * | 8/2012 | Werner et al. | 180/69.24 |

FOREIGN PATENT DOCUMENTS

| | | | |
|---|---|---|---|
| JP | 2001-288777 | A | 10/2001 |
| JP | 3315348 | B2 | 8/2002 |
| JP | 4172135 | B2 | 10/2008 |
| JP | 4364193 | B2 | 11/2009 |
| WO | 2012/056643 | A1 | 5/2012 |

* cited by examiner

*Primary Examiner* — Joseph Rocca
*Assistant Examiner* — Jacob Knutson
(74) *Attorney, Agent, or Firm* — Global IP Counselors, LLP

(57) ABSTRACT

A hydraulic excavator is provided with a lower traveling unit, an upper structure, an engine, a hydraulic pump, an engine compartment, a pump compartment and a plurality of filter devices. The upper structure is rotatably disposed on the lower traveling unit. The pump compartment provided on the upper structure for housing the hydraulic pump. The pump compartment has a door that allows access to an interior of the pump compartment. The filter devices, which are disposed adjacent to each other, are disposed at positions that are mutually offset in a height direction of the hydraulic excavator.

11 Claims, 9 Drawing Sheets

HYDRAULIC EXCAVATOR

BACKGROUND

1. Field of the Invention

The present invention relates to a hydraulic excavator in which are installed various kinds of filter device that filter out impurities contained in engine oil, fuel, etc.

2. Background Information

Filter devices for filtering out impurities contained in engine oil or diesel fuel are installed in modern hydraulic excavators and other such construction machines. For example, Japanese Laid-Open Patent Application 2001-288777 discloses a hydraulic excavator in which a fuel filter, a working fluid filter, and other such auxiliary devices are provided on the inside of an openable door provided to the house of a construction machine so that auxiliary devices that require inspection and maintenance on a regular basis will be disposed at easily accessible locations, thereby improving efficiency and ease of inspection and maintenance.

SUMMARY

However, the following problems were encountered with the conventional hydraulic excavator discussed above. Specifically, with the hydraulic excavator disclosed in the above-mentioned publication, the fuel filter and the working fluid filter were both provided at the same height location on the inside of the openable door provided to the house of the construction machine. Therefore, if space was necessary under the filters during their replacement, the work entailed by the replacement might become more difficult because a plurality of filters were provided at the same height location.

It is an object of the present invention to provide a hydraulic excavator with which the attachment locations of various filters are optimized so that filter replacement work can be carried out more efficiently.

The hydraulic excavator pertaining to the first invention comprises a lower traveling unit capable of traveling by rotating crawler belts, an upper structure that sits on the lower traveling unit in a revolvable state, an engine disposed on the upper structure, a hydraulic pump that is disposed on the upper structure and is driven by the engine, an engine compartment provided on the upper structure for housing the engine, a pump compartment provided to the upper structure for housing the hydraulic pump, and a plurality of filter devices provided along the outer peripheral side of the pump compartment, which is provided with an openable door that allows access to the interior of the pump compartment. At least two or the filter devices are disposed adjacent to each other, there is a space of at least the same size as the filter device in the direction in which each of the filter devices is removed, and the filter devices that are disposed adjacent to each other are disposed at positions that are mutually offset in the height direction.

With this hydraulic excavator, a plurality of filter devices, such as an engine oil filter and a fuel filter, are disposed along the outer periphery inside a pump compartment provided on the upper structure. There is a space of at least the same size as the filter device in the direction in which each of the filter devices is removed. Also, the filter devices that are disposed adjacent to each other are disposed at positions that are mutually offset in the height direction.

Consequently, because all of the filter devices that have to be replaced are located in close proximity in the pump compartment and disposed along the outer periphery thereof, they can be easily accessed through the opening of the openable door during filter replacement. Furthermore, there is a space of at least the same size as the filter device in the direction in which each of the filter devices is removed, and the filter devices that are disposed adjacent to each other are disposed at positions that are mutually offset in the height direction, so enough work space for removing and installing replaceable filters can be ensured around the filter devices during filter replacement. This makes the job easier during filter replacement.

The hydraulic excavator pertaining to the second invention is the hydraulic excavator pertaining to the first invention, wherein the plurality of filter devices are such that the filter device with the longest filter replacement period is disposed relatively farther back from the outer peripheral side in the pump compartment.

Here, the filter device with the longest filter replacement period is disposed farther back, and the filter device with the shortest replacement period is disposed closer to the front, as viewed from the openable door, etc. This allows the work of filter replacement to be carried out more efficiently.

The hydraulic excavator pertaining to the third invention is the hydraulic excavator pertaining to the first or second invention, wherein the plurality of filter devices include an engine oil filter, a fuel pre-filter, and a main fuel filter.

Here, three types of filter device are disposed in the pump compartment. Consequently, the layout can be optimized according to the characteristics of the various filter devices, such as disposing the fuel pre-filter and the engine oil filter, which have relatively short filter replacement lives, on the outer peripheral side of the pump compartment, and disposing the main fuel filter, which has a relatively long filter replacement life, deeper inside the pump compartment.

The hydraulic excavator pertaining to the fourth invention is the hydraulic excavator pertaining to the third invention, wherein the main fuel filter is disposed deeper inside the pump compartment, the fuel pre-filter is disposed ahead of the main fuel filter and on the outer peripheral side toward the rear of the body in the pump compartment, and the engine oil filter is disposed on the outer peripheral side toward the front of the body in the pump compartment.

Here, the layout is optimized by taking into account the filter replacement lives and so forth of the various filter devices. This makes the work more efficient for those filter devices that need to be replaced more frequently (the fuel pre-filter and the engine oil filter).

The hydraulic excavator pertaining to the fifth invention is the hydraulic excavator pertaining to any of the first to fourth inventions, wherein the pump compartment is shielded from the engine compartment. This allows the pump compartment and the engine compartment provided on the upper structure to be disposed in a state in which they are shielded from one another.

The hydraulic excavator pertaining to the sixth invention is the hydraulic excavator pertaining to any of the first to fifth inventions, further comprising an after-treatment apparatus that is installed in the engine compartment for purifying the exhaust gas emitted from the engine.

Here, the after-treatment apparatus for purifying the exhaust gas emitted from the engine disposed on the upper structure is disposed inside the engine compartment. Consequently, a plurality of different types of filter devices can be disposed in close proximity in the pump compartment by moving those filter devices that had been disposed in the engine compartment in the past to the pump compartment adjacent to the engine compartment where space was limited due to the installation of an after-treatment apparatus.

As a result, filter replacement work, maintenance work, and so forth related to filter devices can be carried out more efficiently than with a conventional configuration in which a plurality of filter devices were split up between the engine compartment and the pump compartment.

DETAILED DESCRIPTION OF THE INVENTION

The hydraulic excavator 1 pertaining to an embodiment of the present invention will be described through reference to FIGS. 1 to 6. The "forward and backward" and "left and right" directions used in the following description refer to the directions as seen by the operator seated in the seat inside the cab 10 of the hydraulic excavator 1.

Figure 1:
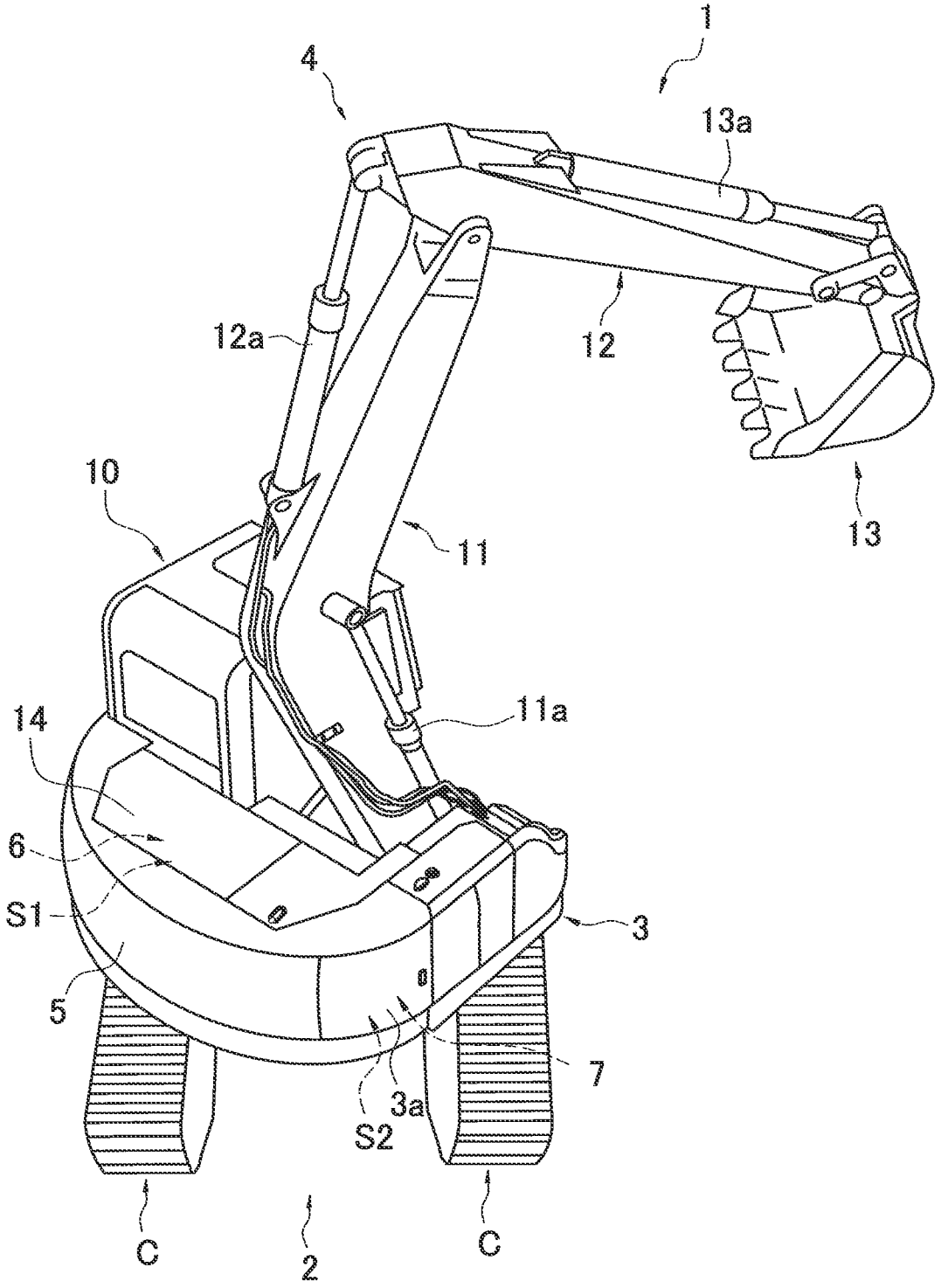
FIG. 1 is an overall oblique view of the configuration of the hydraulic excavator pertaining to an embodiment of the present invention.

The hydraulic excavator 1 pertaining to this embodiment is a short rear-end swing type of hydraulic excavator, and as shown in FIG. 1, comprises a lower traveling unit 2, an upper structure 3, a work implement 4, a counterweight 5, an engine 6, and the cab 10.

The lower traveling unit 2 moves the hydraulic excavator 1 forward and backward by rotating crawler belts C wrapped around the left and right end portions in the travel direction, and has the upper structure 3 installed in a revolvable state on top.

The upper structure 3 is able to revolve in any direction on top of the lower traveling unit 2, and is equipped on its upper face with the work implement 4, the counterweight 5, the engine 6, a hydraulic pump 7, an after-treatment apparatus 8, and the cab 10. The upper structure 3 has an openable inspection door 3*a* on its right-rear side panel. The inspection door 3*a* is provided to a pump compartment S2 in which various kinds of filter device (a main fuel filter 21 (see FIG. 3), and so forth; discussed below) are disposed in order to afford access from outside the body.

As shown in FIG. 1, the work implement 4 has a boom 11, which is bent at its center portion, an arm 12 attached to the distal end of the boom 11, and a bucket 13 attached to the distal end of the arm 12. The hydraulic excavator 1 drives hydraulic cylinders 11*a*, 12*a*, and 13*a* by hydraulic fluid supplied through hydraulic hoses 20, and thereby performs work at a construction site, in which the boom 11, the arm 12, the bucket 13, etc., are moved up and down while excavating dirt, gravel, etc.

The counterweight 5 consists, for example, of a box made of sheet metal and filled with scrap iron, concrete, or the like, and is provided to the rear of an engine compartment S1 on the upper structure 3 to balance the body during digging or the like.

As shown in FIG. 1, the engine 6 is disposed inside the engine compartment S1 adjacent to the counterweight 5. The engine compartment S1 has a top opening that is used for inspection and is covered by an engine hood 14 that can be opened and closed. Adjustment of the engine 6 and so forth disposed in the engine compartment S1 is performed by opening this engine hood 14.

The hydraulic pump 7 is linked to the engine 6, and is driven by the rotational drive force of the engine 6. The hydraulic pump 7 is adjacent to the engine compartment S1 in which the engine 6 is disposed, and is disposed inside the pump compartment S2 (see FIG. 4). The pump compartment S2 is shielded from the engine compartment S1 by a shielding plate so that oil picked up by the hydraulic pump 7 is not scattered into the engine compartment S1.

Figure 2:
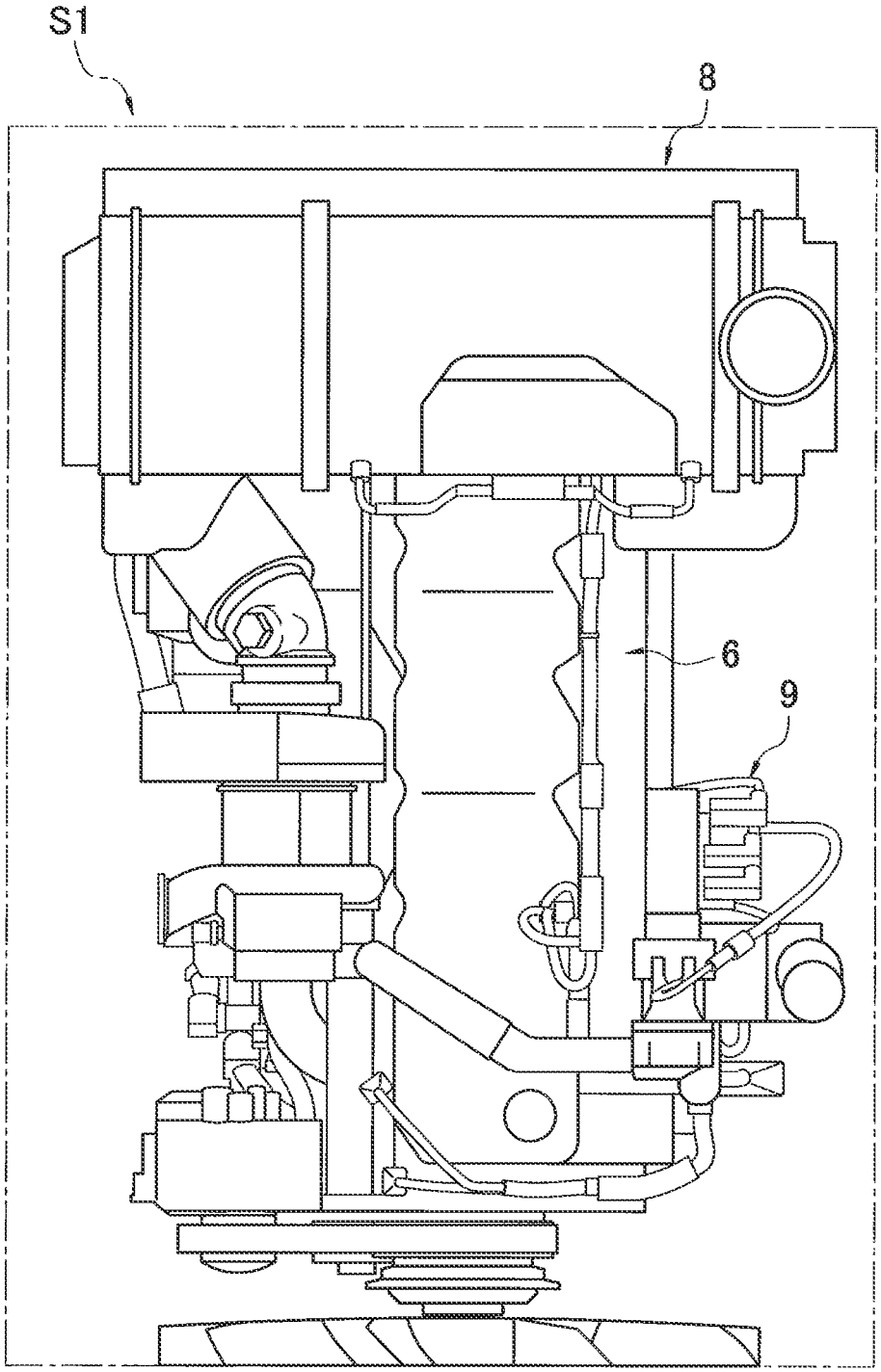
FIG. 2 is a top view of the configuration inside the engine compartment of the hydraulic excavator in FIG. 1.

As shown in FIG. 2, the after-treatment apparatus 8 is disposed above the engine 6 in the engine compartment S1 in order to eliminate harmful substances (such as NOx) contained in the exhaust gas emitted from the engine 6. In this embodiment, since the after-treatment apparatus 8 is disposed above the engine 6 and a sensor 9 to the side, there is not enough space in the engine compartment S1 to dispose the various filter devices. Thus, with the hydraulic excavator 1 in this embodiment, three kinds of filter device (the main fuel filter 21, a fuel pre-filter 22, and an engine oil filter 23) are all provided inside the pump compartment S2. The cab 10 has an interior space in which the operator of the hydraulic excavator 1 rides. The cab 10 has on its left side face an access door for ingress and egress to and from the interior space by the operator.

Figure 3:
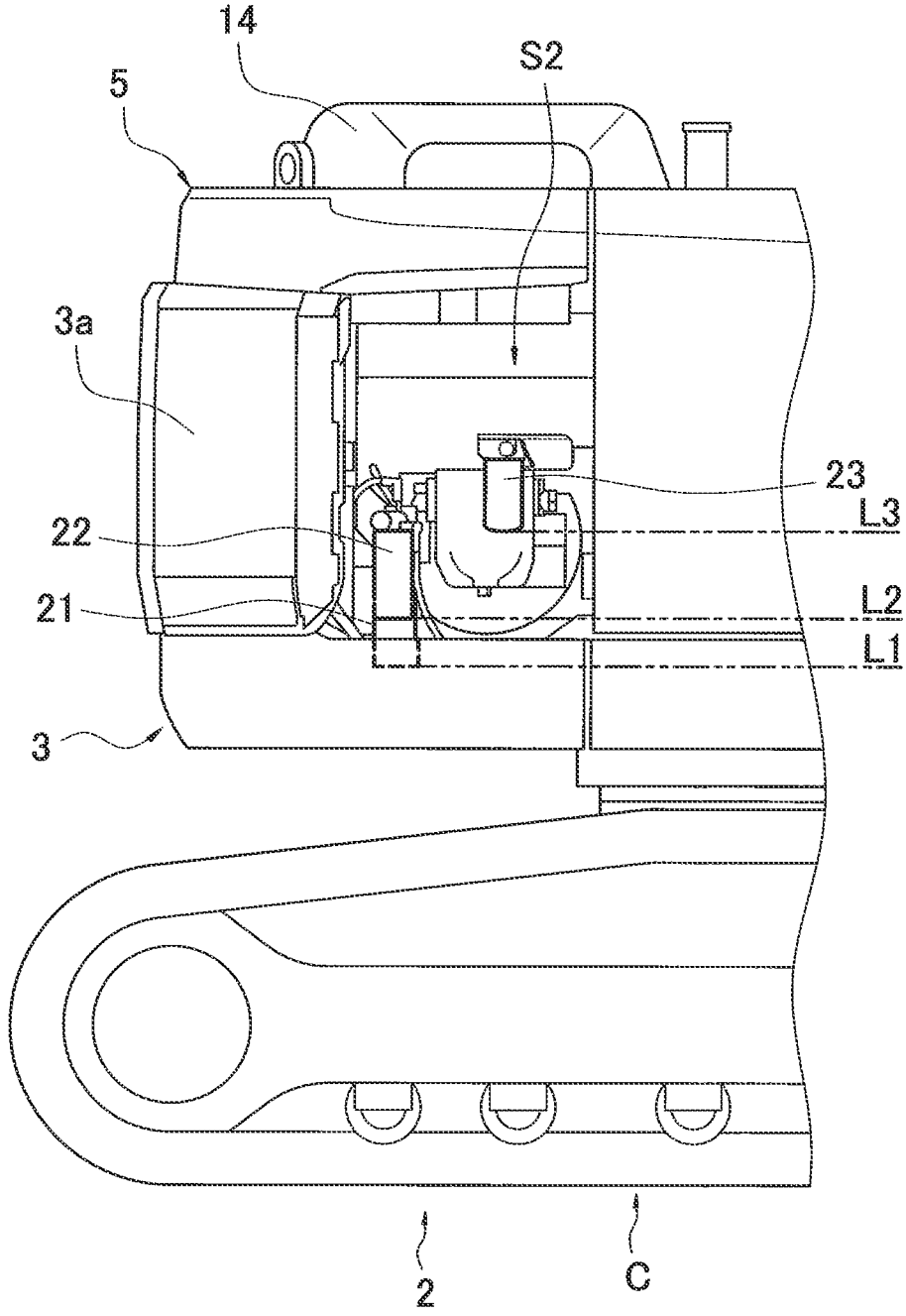
FIG. 3 is a side view of the configuration inside the pump compartment, which can be checked in a state in which an inspection door disposed on the rear side face of the hydraulic excavator in FIG. 1 has been opened.

As shown in FIG. 3, the hydraulic excavator 1 in this embodiment has three kinds of filter device (the main fuel filter 21, the fuel pre-filter 22, and the engine oil filter 23) disposed inside the pump compartment S2, to which opens the inspection door 3*a* provided to the rear side face of the upper structure 3.

Figure 4:
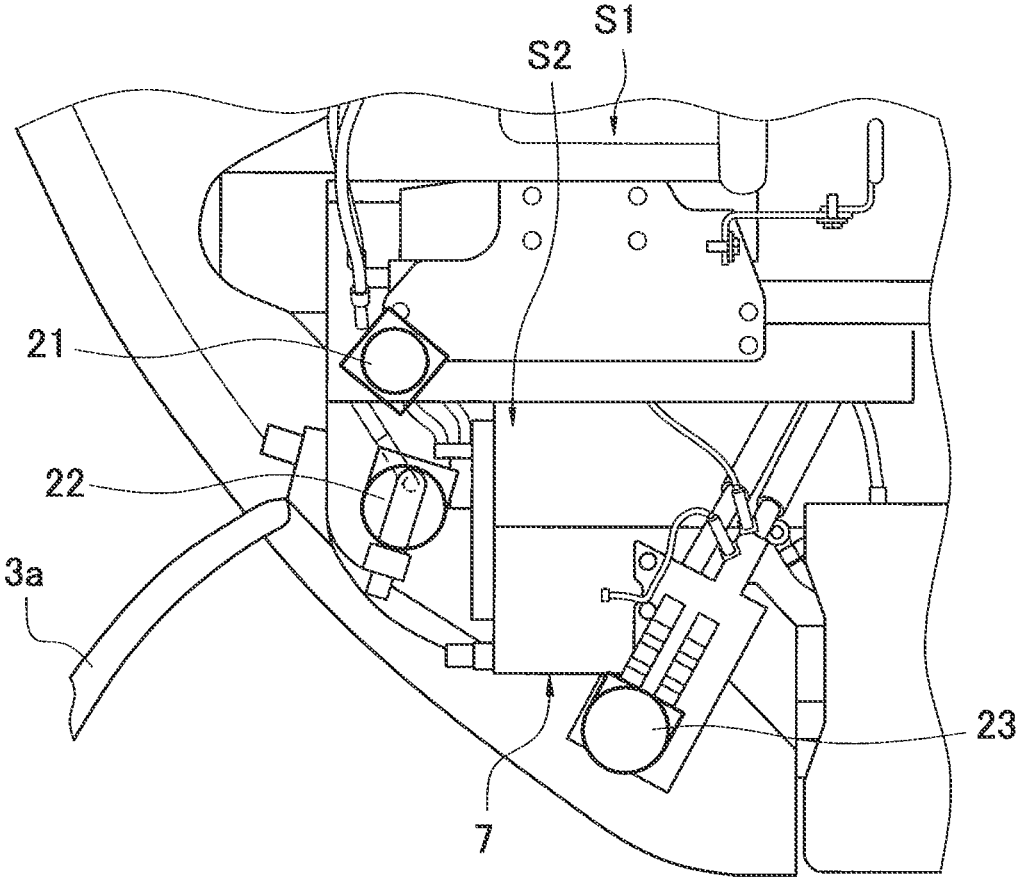
FIG. 4 is a plan view of the configuration inside the pump compartment in FIG. 3.

As shown in FIG. 3, the main fuel filter 21, the fuel pre-filter 22, and the engine oil filter 23 are disposed at different height locations L1, L2, and L3, respectively. Also, as shown in FIG. 4, the main fuel filter 21, the fuel pre-filter 22, and the engine oil filter 23 are disposed at locations that are offset and do not overlap each other in plan view, toward the outer peripheral side of the lower traveling unit 2.

The filter replacement period for these filter devices is approximately 1000 hours for the main fuel filter 21, approximately 500 hours for the fuel pre-filter 22, and approximately 500 hours for the engine oil filter 23. Replacement of these filter devices is performed by using a filter wrench or other such tool in a space beneath the filter device. The route over which diesel fuel is supplied from a fuel tank toward the engine 6 is as follows: fuel tank, the fuel pre-filter 22, the engine 6, the main fuel filter 21, and the combustion chamber of the engine 6.

Figure 5:
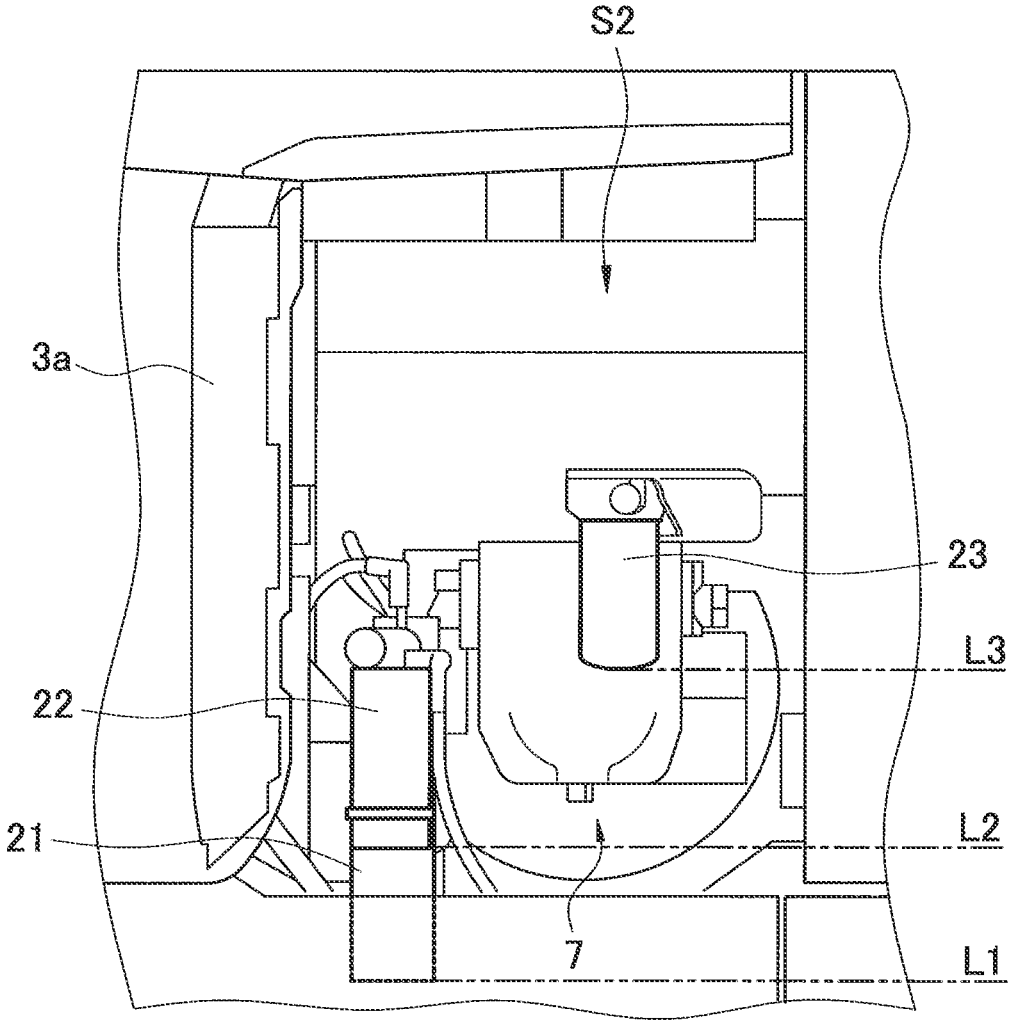
FIG. 5 is a detail side view of the configuration inside the pump compartment in FIG. 3.

The main fuel filter 21 is disposed directly upstream of the engine 6 in the engine compartment S1 in order to filter out impurities contained in the diesel fuel of the hydraulic excavator 1. More specifically, as shown in FIG. 4, the main fuel filter 21 is disposed deeper inside than the other filter devices (the fuel pre-filter 22 and the engine oil filter 23). As shown in FIG. 5, the main fuel filter 21 is disposed so that its lower face is at a lower location (the height location L1) than the other filter devices.

The main fuel filter 21 here is disposed the furthest to the inside when viewed from the opening of the inspection door 3*a*. As shown in FIG. 5, the main fuel filter 21 has an adjacent space that is at least the same size as the main fuel filter 21 in its removal direction, so even though it is disposed lower than the other filter devices, there is still enough work space for the operator to insert a hand or to use a filter wrench or other such tool. Also, since the main fuel filter 21 is disposed at a different height location from that of the adjacently disposed fuel pre-filter 22, there is enough work space for the replacement of the fuel pre-filter 22.

The main fuel filter 21 has the longest filter replacement period, so it needs to be replaced less often than the other filter devices. Thus, in this embodiment, the main fuel filter 21 is disposed deeper inside than the fuel pre-filter 22 or the engine oil filter 23, which is done for the purpose of facilitating filter replacement work.

The fuel pre-filter 22 is a filter device with a coarser mesh than the main fuel filter 21, and is provided in order to filter out impurities contained in the diesel fuel, just as is the main fuel filter 21, and is disposed directly downstream from the fuel tank (not shown) in the pump compartment S2. More specifically, as shown in FIG. 4, the fuel pre-filter 22 is disposed at a location on the outer peripheral side of the pump compartment S2, in front of the main fuel filter 21 as seen from the opening of the inspection door 3*a*. As shown in FIG. 5, the fuel pre-filter 22 is disposed so that its lower face is at a location (the height location L2) that is higher than the adjacent main fuel filter 21 and is lower than the engine oil filter 23.

Here, the fuel pre-filter 22 is disposed in front as seen from the opening of the inspection door 3*a*. Also, even though the main fuel filter 21 is disposed adjacent, the fuel pre-filter 22 has an adjacent space that is at least the same size as the fuel pre-filter 22 in its removal direction, as shown in FIG. 5, so there is still enough work space for the operator to insert a hand or to use a filter wrench or other such tool.

Since the fuel pre-filter 22 has a relatively short filter replacement period (approximately 500 hours), it will need to be replaced more often than the main fuel filter 21. Thus, in this embodiment, the fuel pre-filter 22 is disposed in front of the main fuel filter 21, and a location that is easier to reach, which is done for the purpose of facilitating filter replacement work.

The engine oil filter 23 is disposed directly upstream from the engine 6 inside the pump compartment S2 in order to filter out any impurities contained in the engine oil. More specifically, as shown in FIG. 4, the engine oil filter 23 is disposed at a location on the outer peripheral side of the pump compartment S2 and at the very front as seen from the opening of the inspection door 3*a*. The engine oil filter 23 is also disposed at a location that is away from the other filter devices, and toward the front of the body on the upper structure 3. As shown in FIG. 5, the engine oil filter 23 is also disposed so that the location of its lower face (height location L3) is higher than the main fuel filter 21 and the fuel pre-filter 22.

Here, the engine oil filter 23 is disposed on the front side as seen from the opening of the inspection door 3*a*. As shown in FIG. 5, the engine oil filter 23 has an adjacent space of at least the same size as the engine oil filter 23 in its removal direction, so there is enough work space for the operator to insert a hand or to use a filter wrench or other such tool.

Just as with the fuel pre-filter 22, since the engine oil filter 23 has a relatively short filter replacement period (approximately 500 hours), it will need to be replaced more often than the main fuel filter 21. Thus, in this embodiment, the engine oil filter 23 is disposed at the front as seen from the opening of the inspection door 3*a*, at a location that is easier to reach, which is done for the purpose of facilitating filter replacement work, just as with the fuel pre-filter 22.

As shown in FIGS. 4 and 5, the hydraulic excavator 1 in this embodiment comprises a plurality of filter devices (the main fuel filter 21, the fuel pre-filter 22, and the engine oil filter 23) that are provided at locations on the outer peripheral side in the pump compartment S2 to which the inspection door 3*a* is provided, and are disposed offset in the height direction. Also, the plurality of filter devices (the main fuel filter 21, the fuel pre-filter 22, and the engine oil filter 23) are such that the main fuel filter 21 and the fuel pre-filter 22 are disposed adjacent to each other, and there is a space of at least the same size as the filter device in the removal direction of each filter device (downward in FIG. 5).

Figure 6:
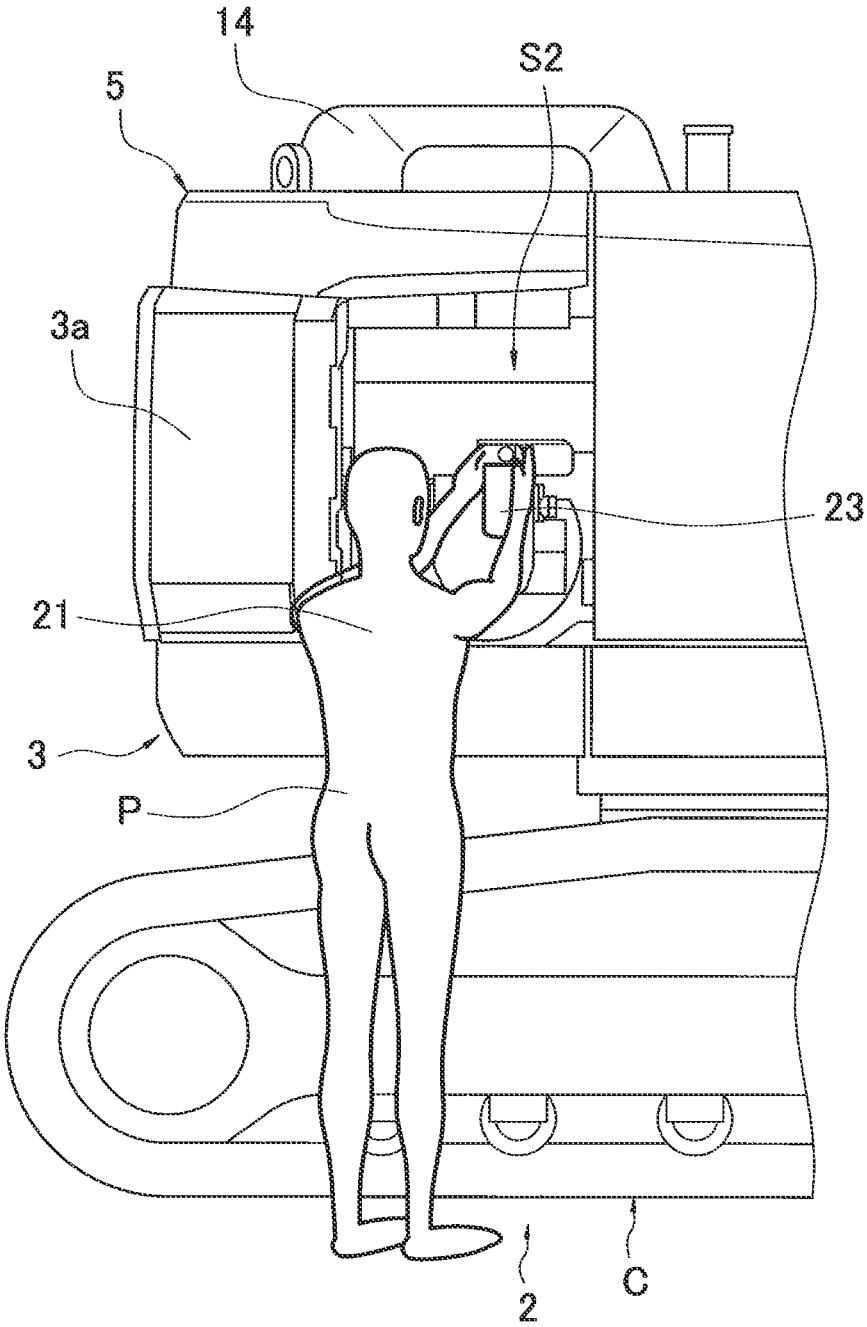
FIG. 6 is a side view of the state when an operator has accessed the pump compartment in FIG. 3.

Consequently, even though the main fuel filter 21 and the fuel pre-filter 22 are disposed adjacent to each other, as shown in FIG. 6, there is enough work space in the direction in which the filter devices are removed during filter replacement work in a state in which the inspection door 3*a* is open while the operator is replacing a filter, and this makes the filter replacement work more efficient.

Figure 7:
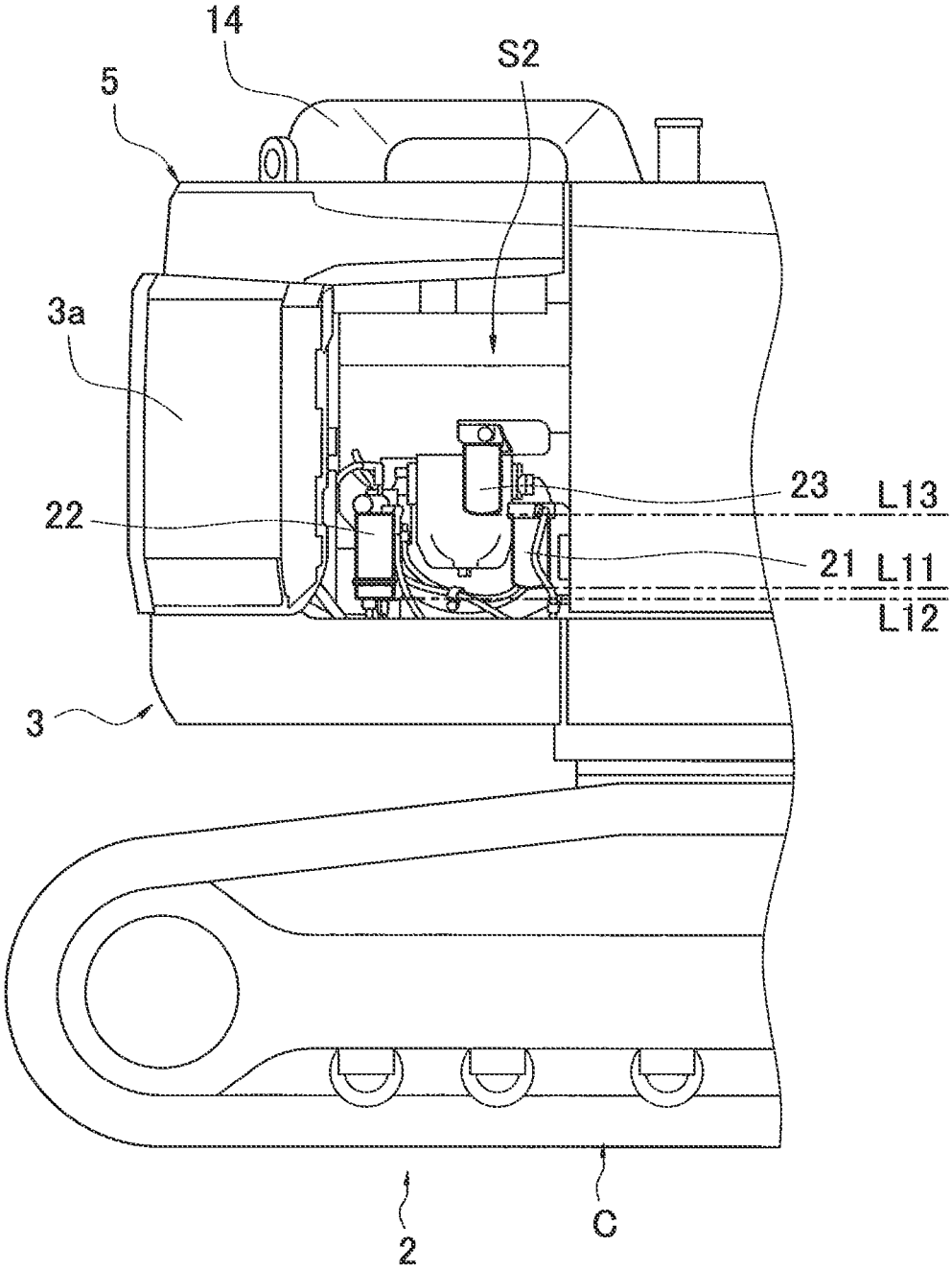
FIG. 7 is a side view of the configuration inside the pump compartment, which can be checked in a state in which an inspection door disposed on the rear side face of the hydraulic excavator pertaining to another embodiment has been opened.

The hydraulic excavator 1 pertaining to another embodiment of the present invention will be described through reference to FIGS. 7 to 9.

This embodiment differs from the configuration in Embodiment 1 above in the layout of the main fuel filter 21, the fuel pre-filter 22, and the engine oil filter 23. The rest of the configuration, however, is the same, so those members having the same function will be numbered the same and not described again.

Specifically, in this embodiment, the main fuel filter 21 and the engine oil filter 23 are disposed adjacent and at different height locations in a space on the right side as seen from the opening of the inspection door 3*a*, and the fuel pre-filter 22 is disposed by itself in a space on the left side. The layout of the filter devices will be described in more specific terms below.

Figure 8:
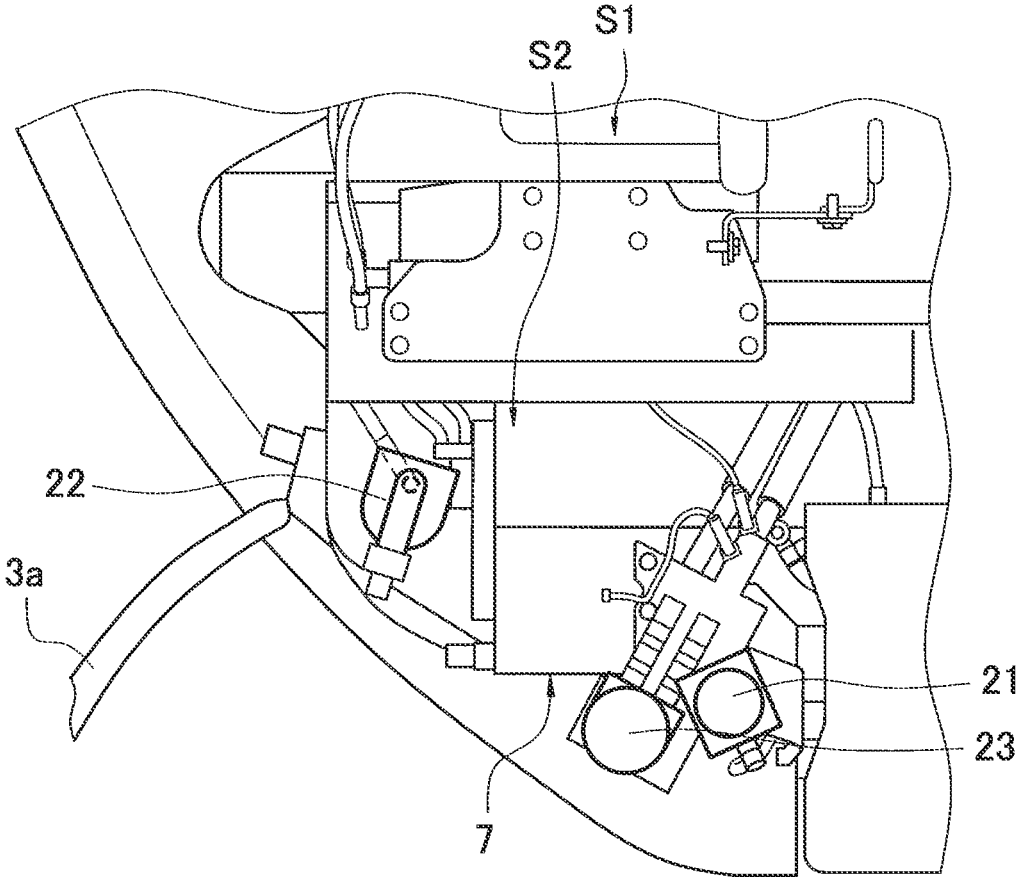
FIG. 8 is a plan view of the configuration inside the pump compartment in FIG. 7.

As shown in FIG. 8, the main fuel filter 21 is disposed farther to the right than the other filter devices (the fuel pre-filter 22 and the engine oil filter 23) as seen from the opening of the inspection door 3*a*. As shown in FIG. 9, the main fuel filter 21 is disposed so that the location of its lower face is lower than the engine oil filter 23 disposed adjacent to it, and at the same location (height location L11) as the fuel pre-filter 22.

Figure 9:
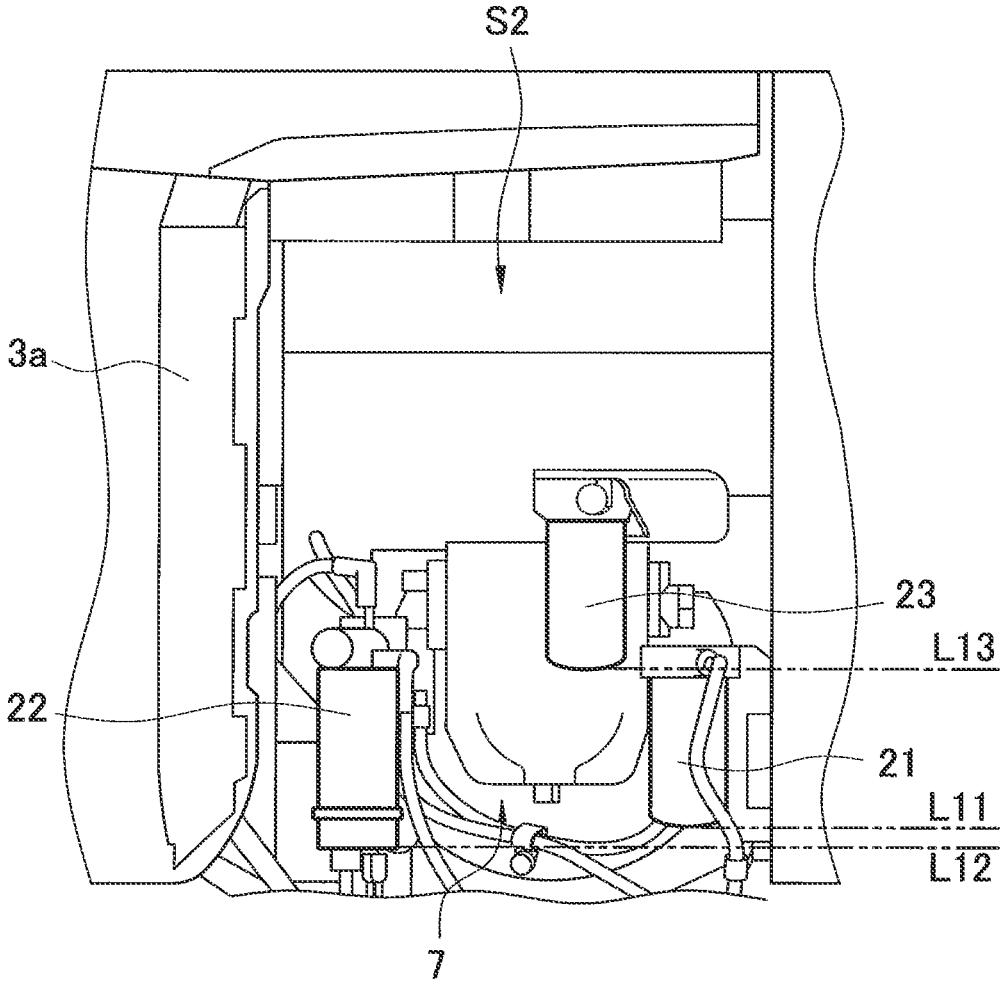
FIG. 9 is a detail side view of the configuration inside the pump compartment in FIG. 7.

The main fuel filter 21 here is disposed deeper inside than the engine oil filter 23 as seen from the opening of the inspection door 3*a*, but as shown in FIG. 9, since it is disposed below the adjacent engine oil filter 23, there is enough work space for the operator to insert a hand or to use a filter wrench or other such tool.

As discussed above, the main fuel filter 21 has the longest filter replacement period, so it is replaced less often than the other filter devices. Thus, in this embodiment the main fuel filter 21 is disposed the further inside from the opening than the fuel pre-filter 22 and the engine oil filter 23, which have shorter replacement periods, which is done for the purpose of facilitating filter replacement work.

As shown in FIG. 8, the fuel pre-filter 22 is disposed on the outer peripheral side toward the rear end of the pump compartment S2 as seen from the opening of the inspection door 3*a*. Also, as shown in FIG. 9, the fuel pre-filter 22 is disposed so that the location of its lower face is the same as that of the main fuel filter 21, and at a location (height location L12) lower than the engine oil filter 23.

Here, since the fuel pre-filter 22 is disposed at the front as seen from the opening of the inspection door 3*a*, then as shown in FIG. 9 there is enough work space for the operator to insert a hand or to use a filter wrench or other such tool.

As discussed above, the fuel pre-filter 22 has a shorter filter replacement period (approximately 500 hours), so it needs to be replaced more often than the main fuel filter 21. Thus, in this embodiment the fuel pre-filter 22 is disposed at a location that is easy to reach on the outer peripheral side in the pump compartment S2, which is done for the purpose of facilitating filter replacement work.

As shown in FIG. 8, the engine oil filter 23 is disposed at a location on the outer peripheral side of the pump compartment S2 that is at the very front as seen from the opening of the inspection door 3*a*. Also, the engine oil filter 23 is disposed adjacent to the main fuel filter 21. Furthermore, as shown in FIG. 9, the engine oil filter 23 is disposed so that its lower face is at a higher location (the height location L13) than the fuel pre-filter 22.

Here, since the engine oil filter 23 is disposed at the front as seen from the opening of the inspection door 3*a*, as shown in FIG. 9, there is enough work space for the operator to insert a hand or to use a filter wrench or other such tool.

As discussed above, the engine oil filter 23 is similar to the fuel pre-filter 22 in that it has a shorter filter replacement period (approximately 500 hours), so it needs to be replaced more often than the main fuel filter 21. Thus, in this embodiment the engine oil filter 23, just like the fuel pre-filter 22, is disposed at the front as seen from the opening of the inspection door 3*a*, at a location that is easier to reach, which is done for the purpose of facilitating filter replacement work.

With the hydraulic excavator in this embodiment, just as in Embodiment 1 above, and as shown in FIGS. 8 and 9, there are a plurality of filter devices (the main fuel filter 21, the fuel pre-filter 22, and the engine oil filter 23) disposed offset in the height direction and provided at locations on the outer peripheral side in the pump compartment S2 to which the inspection door 3*a* is provided. Also, the plurality of filter devices (the main fuel filter 21, the fuel pre-filter 22, and the engine oil filter 23) are such that the main fuel filter 21 and the engine oil filter 23 are disposed adjacent to each other, and there is a space of at least the same size as the filter device in the removal direction of each filter device (downward in FIG. 9).

Consequently, the same effect is obtained as in Embodiment 1 above, namely, that there is enough work space in the direction in which the filter devices are removed during filter replacement work in a state in which the inspection door 3*a* is open while the operator is replacing a filter, and this makes the filter replacement work more efficient.

Embodiments of the present invention were described above, but the present invention is not limited to or by these embodiments, and various modifications are possible without departing from the gist of the invention.

(A) In Embodiments 1 and 2 above, an example was given in which the filter devices were disposed so that the height locations of the main fuel filter 21, the fuel pre-filter 22, and the engine oil filter 23 were all different, but the present invention is not limited to this. For example, the plurality of filter devices may be disposed so that the height locations of two or more mutually adjacent filter devices are different.

(B) In Embodiments 1 and 2 above, an example was given in which the main fuel filter 21, the fuel pre-filter 22, and the engine oil filter 23 were disposed so that the height locations were mutually different using as a reference the location of the lower face of the filter devices, but the present invention is not limited to this. For example, the filter devices may be disposed so that their height locations differ on the basis of the center locations of the filter devices.

(C) In Embodiments 1 and 2 above, the main fuel filter 21, the fuel pre-filter 22, and the engine oil filter 23 were given as examples of a plurality of filter devices, but the present invention is not limited to or by this. For example, the present invention may be applied to a hydraulic excavator equipped with other kinds of filter device.

(D) In Embodiments 1 and 2 above, an example was given in which three kinds of filter device were disposed in the pump compartment S2, but the present invention is not limited to or by this. For example, two kinds, or four or more kinds, may be disposed in the pump compartment.

Also, rather than all of the filter devices being of different kinds, filter devices of the same kind may be included in the plurality of filter devices.

The hydraulic excavator of the present invention has the effect of optimizing the locations were various kinds of filter device are attached, and thereby allowing the work of replacing the filters to be carried out more efficiently, so it can be widely applied to various kinds of construction machine equipped with a plurality of filter devices.

The invention claimed is:

1. A hydraulic excavator comprising:

a lower traveling unit configured to travel by rotating crawler belts;

an upper structure rotatably disposed on the lower traveling unit;

an engine disposed on the upper structure;

a hydraulic pump disposed on the upper structure and driven by the engine;

an engine compartment provided on the upper structure for housing the engine;

a pump compartment provided to the upper structure for housing the hydraulic pump; and a plurality of filter devices provided along an outer peripheral side of the pump compartment, the pump compartment having an openable door that allows access to an interior of the pump compartment, at least two of the plurality of filter devices being disposed on a near side from an opening of the openable door, at least two of the plurality of filter devices being disposed adjacent to each other, and the at least two filter devices that are disposed adjacent to each other being disposed at positions that are mutually offset in a height direction of the hydraulic excavator, the plurality of filter devices including an engine oil filter, a fuel pre-filter, and a main fuel filter, and the main fuel filter being disposed deeper inside the pump compartment than the pre-filter and the engine oil filter from the opening of the openable door, the fuel pre-filter being disposed ahead of the main fuel filter with respect to the upper structure and on the outer peripheral side toward a rear of the upper structure in the pump compartment, and the engine oil filter being disposed on the outer peripheral side toward a front of the upper structure in the pump compartment.

2. The hydraulic excavator according to claim 1, wherein the two filter devices that are disposed adjacent to each other includes a first filter device and a second filter device, the first filter device having a bottom surface that is disposed above a level of an upper surface of the second filter device.

3. The hydraulic excavator according to claim 2, wherein a first one of the plurality of filter devices, which has a longest filter replacement period, is disposed relatively farther back from the outer peripheral side in the pump compartment than remaining ones of the plurality of filter devices.

4. The hydraulic excavator according to claim 2, further comprising the pump compartment is shielded from the engine compartment.

5. The hydraulic excavator according to claim 2, wherein an after-treatment apparatus installed in the engine compartment for purifying the exhaust gas emitted from the engine.

6. The hydraulic excavator according to claim 1, wherein a first one of the plurality of filter devices, which has a longest filter replacement period, is disposed relatively farther back from the outer peripheral side in the pump compartment than remaining ones of the plurality of filter devices.

7. The hydraulic excavator according to claim 6, further comprising the pump compartment is shielded from the engine compartment.

8. The hydraulic excavator according to claim 6, wherein an after-treatment apparatus installed in the engine compartment for purifying the exhaust gas emitted from the engine.

9. The hydraulic excavator according to claim 1, further comprising the pump compartment is shielded from the engine compartment.

10. The hydraulic excavator according to claim 9, wherein an after-treatment apparatus installed in the engine compartment for purifying the exhaust gas emitted from the engine.

11. The hydraulic excavator according to claim 1, wherein an after-treatment apparatus installed in the engine compartment for purifying the exhaust gas emitted from the engine.

* * * * *